US008498178B2

(12) United States Patent
Antoine et al.

(10) Patent No.: US 8,498,178 B2
(45) Date of Patent: Jul. 30, 2013

(54) ACOUSTIC TRANSDUCER CHIP

(75) Inventors: Christophe Antoine, Somerville, MA (US); Andrew W. Sparks, Cambridge, MA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 13/324,565

(22) Filed: Dec. 13, 2011

(65) Prior Publication Data

US 2012/0163129 A1 Jun. 28, 2012

Related U.S. Application Data

(60) Provisional application No. 61/426,847, filed on Dec. 23, 2010.

(51) Int. Cl.
*B06B 1/02* (2006.01)

(52) U.S. Cl.
USPC ..... 367/138

(58) Field of Classification Search
USPC ..... 367/137, 138, 119, 123, 153
See application file for complete search history.

(56) References Cited

U.S. PATENT DOCUMENTS

| | | | | |
|---|---|---|---|---|
| 3,806,930 | A * | 4/1974 | Gobert | 342/368 |
| 6,128,421 | A * | 10/2000 | Roberts | 385/3 |
| 6,795,374 | B2 | 9/2004 | Barnes et al. | 367/138 |
| 6,865,140 | B2 * | 3/2005 | Thomenius et al. | 367/155 |
| 6,867,720 | B1 | 3/2005 | Freeman et al. | 341/143 |
| 7,087,023 | B2 | 8/2006 | Daft et al. | 600/459 |
| 7,257,051 | B2 * | 8/2007 | Thomenius et al. | 367/153 |
| 7,280,435 | B2 * | 10/2007 | Thomenius et al. | 367/153 |
| 7,491,566 | B2 | 2/2009 | Brosnihan et al. | 438/50 |
| 7,545,075 | B2 | 6/2009 | Huang et al. | 310/309 |
| 7,589,455 | B2 * | 9/2009 | Adachi et al. | 310/335 |
| 7,728,490 | B2 | 6/2010 | Adachi et al. | 310/334 |
| 2004/0160144 | A1 | 8/2004 | Daft et al. | 310/334 |
| 2005/0169107 | A1 * | 8/2005 | Thomenius et al. | 367/155 |
| 2005/0176163 | A1 | 8/2005 | Brosnihan et al. | 438/48 |
| 2007/0016026 | A1 * | 1/2007 | Thomenius et al. | 600/437 |
| 2008/0141521 | A1 * | 6/2008 | Ladabaum et al. | 29/594 |

(Continued)

FOREIGN PATENT DOCUMENTS

| | | |
|---|---|---|
| EP | 1839765 | 3/2007 |
| EP | 2154491 | 2/2010 |
| WO | WO 2009/146140 | 12/2009 |

OTHER PUBLICATIONS

Daft et al., "cMuts and electronics for 2D and 3D imaging: Monolithic integration, in-handle chip sets and system implications", 2005 IEEE Ultrasonic Symposium, pp. 463-474.*

(Continued)

*Primary Examiner* — Ian Lobo
(74) *Attorney, Agent, or Firm* — Sunstein Kann Murphy & Timbers LLP

(57) ABSTRACT

An array of acoustic transducing unit cells configured with an acoustic focus or a beam steering orientation. A variety of time delays between consecutively coupled acoustic transducing unit cells provides acoustic focus. In another configuration, a resistive signal path between adjacent acoustic transducing unit cells can be used to acoustically steer an acoustic beam in a direction non-normal to the top surface in which the array is disposed. In a further embodiment, a signal pad is made available at each end of the connections through an array of capacitive micromachined ultrasonic transducing unit cells.

32 Claims, 9 Drawing Sheets

U.S. PATENT DOCUMENTS

| | | | | |
|---|---|---|---|---|
| 2008/0212807 | A1 * | 9/2008 | Wang | 381/190 |
| 2009/0182229 | A1 * | 7/2009 | Wodnicki | 600/437 |
| 2010/0036257 | A1 | 2/2010 | Sano et al. | 600/459 |

OTHER PUBLICATIONS

Daft et al., "Two approaches to Electroniocally Scanned 3D Imaging using cMuts", 2006 IEEE Ultrasonics SYmposium, pp. 685-688.*

Daft et al. Elevation Beam Profile Control with Bias Polarity Patterns Applied to Microfabricated Ultrasound Transducers, 2003 IEEE Ultrasonics Symposium, pp. 1578-1581.

International Searching Authority International Search Report—International Application No. PCT/US2011/064672, dated Jun. 11, 2012, together with the Written Opinion of the International Searching Authority, 11 pages.

* cited by examiner

ACOUSTIC TRANSDUCER CHIP

The present application claims priority from U.S. provisional application Ser. No. 61/426,847, filed Dec. 23, 2010, the full disclosure of which is hereby incorporated herein by reference in its entirety.

TECHNICAL FIELD

The present invention relates to acoustic transducers, and more particularly to ultrasonic transducers integrated onto a semiconductor chip.

BACKGROUND ART

In a typical ultrasonic transducer array, each transducing unit cell, sometimes known as a subelement, in the array is conductively connected to one another so that they may all be simultaneously driven as one acoustic element. To focus such an array, it is conventional to make use of a lens. The lens can be made of organic polymer akin to rubber, e.g. Room-Temperature-Vulcanizing (RTV) silicone elastomers. During the assembly process of the transducer array, this polymer needs to be cured to turn into a durable form thanks to the addition of sulfur. This process needs to be tightly controlled, often requiring manual manipulation by a human operator. The overall process is thus time consuming and expensive.

An acoustic element is made up of an array of transducing unit cells. Each individual transducing unit cell includes a pair of plates or electrodes, at least one in each pair being deformable so as to move reciprocally closer to and further from the other in the pair. This movement creates the acoustic signal. An acoustic transducer chip may include many acoustic elements juxtaposed to form the long axis of the chip in azimuth. The short axis of the chip is the elevation axis, which extends across the transducing unit cells in an array within an acoustic element.

Focusing or beam steering an acoustic transducer chip in azimuth is accomplished by adjusting the time delay for each signal sent to or received from each of the acoustic elements on the chip. The electronics may thus be used to shape or steer the beam. U.S. Pat. No. 7,087,023 (Daft et al.) illustrates how electronics can be used to focus an acoustic transducer array in elevation. The arrays are configured so that the DC bias can be separately applied to the transducers at any given row in elevation. A pattern of positive and negative bias voltages applied to different elevation rows can be used to create a desired focal zone in elevation.

SUMMARY OF THE INVENTION

In accordance with embodiments of the invention, focusing and/or beam steering is integrated into the acoustic transducer itself. In one embodiment, there is provided an acoustic transducer chip having at least one array of at least three acoustic transducing unit cells electrically coupled by a signal path having independently defined time delay elements between consecutively coupled acoustic transducing unit cells so as to acoustically focus the acoustic beam emitted by the array. Each acoustic transducing unit cell includes a pair of electrodes. At least one electrode of each pair is deformable. The electrodes of a capacitive micromachined ultrasonic transducer (CMUT) embodiment operate within a vacuum cavity. In one embodiment, the electrodes are formed by doped polysilicon. In another embodiment, the electrodes are formed by doped amorphous silicon. In a still further embodiment, the electrodes are metal.

The variety of time delays is achieved in the structure of the acoustic transducer chip. The time delays can be varied by varying the electrical resistances between acoustic transducing unit cells along the array or varying the capacitances of the acoustic transducing unit cells or by doing both. A variety of electrical resistances can be achieved on the acoustic transducer chip by creating a location-dependent doping profile. The variety of electrical resistances can alternatively be achieved by forming the conductive paths between the acoustic transducing unit cells with different sizes or shapes to create the different resistances. The electrical resistance values can be modified after fabrication by permitting selection from a library of possible resistors or through use of programmable resistors. A programmable resistor may be made so that it can be trimmed after fabrication. Alternatively, programmable resistors can be formed by transistors whose effective resistance can be controlled with a signal that adjusts gate voltage. The variety of capacitances on an acoustic transducer chip can be achieved by varying the sizes of the electrode pairs.

In accordance with an embodiment of the invention, focusing and/or beam steering is incorporated into an acoustic transducer chip made up of CMUTs. In alternative embodiments, the transducer chip may be made up of piezoelectric transducing unit cells, such as piezoelectric micromachined ultrasonic transducers (PMUTs). The variety of time delay elements may be configured so as to focus the acoustic transducer array to generate a spherical phase front. The varied delay elements can be used to focus the acoustic transducer array to generate a shaped amplitude front.

Beam steering could be achieved with as few as two acoustic transducing unit cells in the array. Thus, according to a further embodiment there is provided an acoustic transducer chip having a top surface with an array of at least two acoustic transducing unit cells electrically coupled by a resistive signal path between adjacent acoustic transducing unit cells so as to acoustically steer an acoustic beam non-normal to the top surface of the acoustic transducer chip. In a particular embodiment, the at least two acoustic transducing unit cells are aligned in elevation and the beam is steered in elevation.

In further embodiments, the acoustic transducer chip, may include one or more additional arrays of acoustic transducing unit cells so as to form a two dimensional array of acoustic transducing unit cells.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Figure 1:
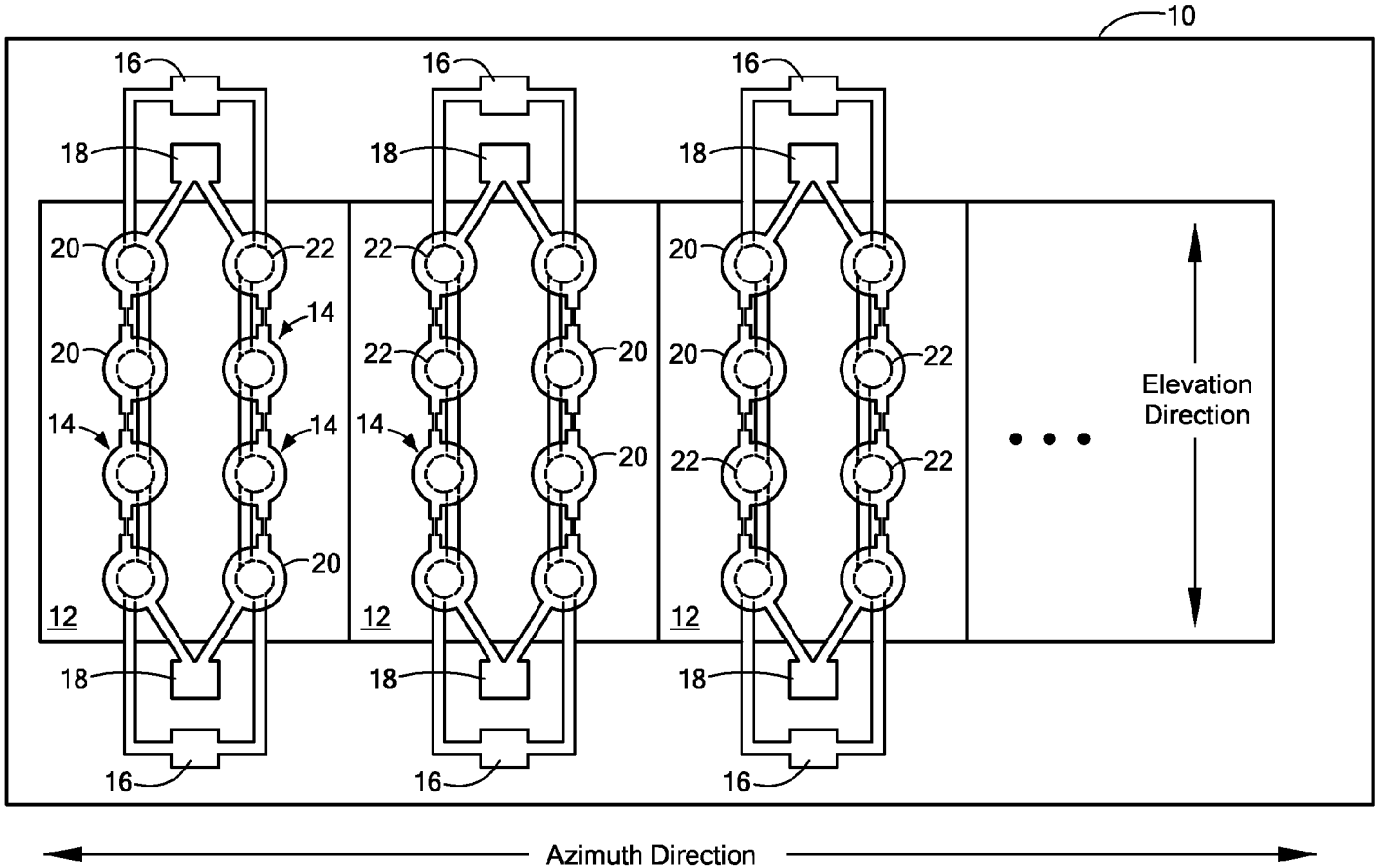
FIG. 1 is a top schematic view of a one-dimensional acoustic transducer chip of an embodiment of the present invention.

Referring now to FIG. 1, an acoustic transducer chip 10 is shown. The chip includes a series of acoustic elements 12 juxtaposed one after the other to create a long chip in the azimuthal direction. Each acoustic element 12 is made up of at least one array of electrically coupled acoustic transducing unit cells 14. In a linear one dimensional transducer chip, the acoustic elements are aligned in the azimuthal direction and the acoustic transducing unit cells of each array are arranged in the elevational direction. Each acoustic element 12 has one or two signal pads 16 for electronically controlling the production of acoustic signals by the acoustic transducing unit cells when in transmission or for passing along electronic signals produced by the acoustic transducing unit cells when in reception of acoustic signals. Each acoustic transducing unit cell includes a pair of electrodes, at least one of the electrodes being deformable. FIG. 1 illustrates a top electrode 20 and a bottom electrode (in dashed lines) 22 for each acoustic transducing unit cell. At least one signal pad 18, but preferably at least two signal pads, is connected to one of the electrodes in each electrode pair. The signal pads 18 are intended for providing an AC signal. In this case, the signal pads 18 are connected to the top electrodes 20. The other electrode in the pair are connected to the other at least one pad 16. Pad 16 may be connected to ground. A DC bias between the electrodes is connected to either the top or the bottom plate in the CMUT embodiment. The AC signal stimulates the deformable electrode to move reciprocally at a designated frequency.

It is typically desirable for each array of transducing unit cells to be aligned in the elevational direction. All of the cells in an array may be located directly on an axis of alignment. In other embodiments, substantial alignment of the cells may be sufficient. The cells are said to be substantially aligned if they are all within a distance from an axis of alignment by no more than half of the acoustic operating wavelength of the transducer. Thus, for an acoustic transducer with a range of acoustic operating frequencies, the cells in an array should be no more than half of the wavelength of the highest operating frequency in the range away from the axis of alignment.

Figure 2:
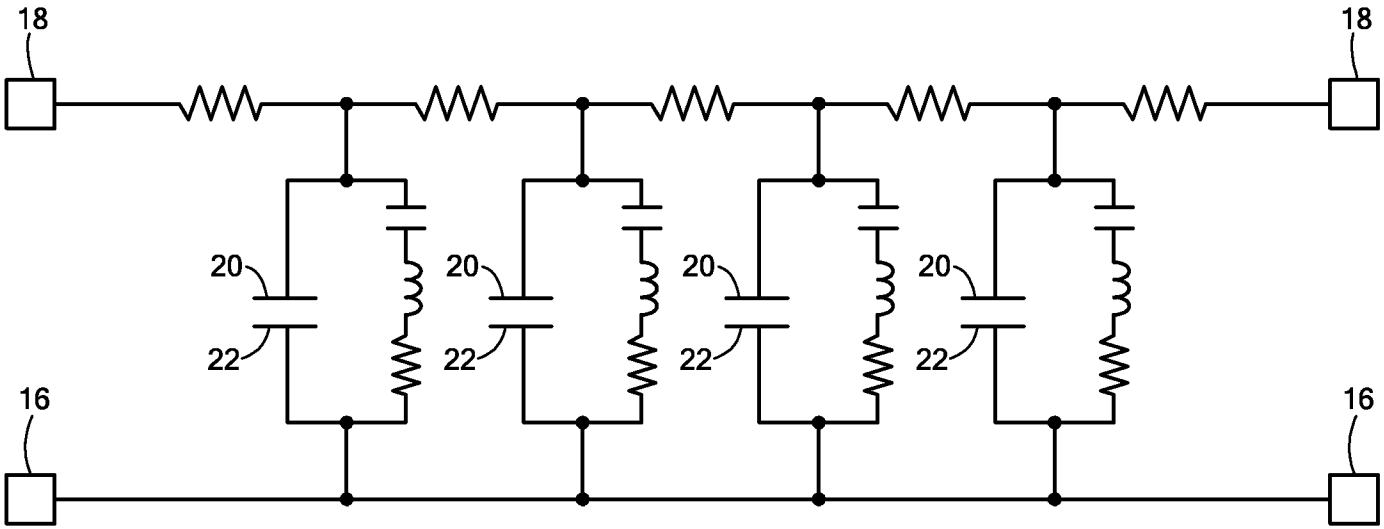
FIG. 2 is an electrical schematic of an array of acoustic transducing unit cells electrically coupled to a signal path from the acoustic chip of FIG. 1.

As shown schematically in FIG. 2, a resistive signal path is provided from top electrode 20 to top electrode 20 in each of the acoustic transducing unit cells through the array of transducing unit cells. Alternatively, or in addition, resistive signal path may be provided through the bottom electrodes 22. The electrical resistances between one pair of adjoining acoustic transducing unit cells may be made to differ from the electrical resistance between a second pair of adjoining acoustic transducing unit cells. As such, a variety of electrical resistances may be implemented between acoustic transducing unit cells along the array. Indeed, during manufacture a location-dependent doping profile may be used to achieve a desired pattern of a variety of electrical resistances between transducing unit cells along an array. In other embodiments, the variety of electrical resistances could be modifiable after fabrication.

The electrode pair of each acoustic transducing unit cell is further characterized by a capacitance between the electrodes. Indeed, the electrodes are typically referred to as plates in CMUTs. For a given DC bias between the top and bottom electrodes, each electrode pair will have a determined bias capacitance. As the electrodes are deformed during operation the capacitance value changes about the operating bias capacitance. The electrical resistances between the acoustic transducing unit cells and the capacitances of the transducing unit cells combine to form an RC network. Thus, a signal introduced to the array will encounter a variety of time delay elements in series as it passes from one transducing unit cell to the next along the array of acoustic transducing unit cells.

By varying the electrical resistances between transducing unit cells and/or varying the bias capacitances of the electrode pairs in the array, the acoustic transducer chip can be designed to shape a beam in the axis of alignment of the acoustic transducing unit cells in any predetermined desired shape. One way for varying the capacitances is to vary the size of the electrode pairs of the transducing unit cells in the array. This can be accomplished by varying the electrode diameters or varying the thickness of the electrodes. Methods for varying electrical resistances are described in more detail below. The variety of time delays imposed by the varied time delay elements will affect the phase front in elevation of a beam produced by the array. The resistances between the acoustic transducing unit cells may also impose attenuation on the signal through the signal path and may thus be used to shape the amplitude of the beam.

FIGS. 1 and 2 show arrays of four acoustic transducing unit cells 14 aligned in the elevational direction. With an array of at least three acoustic transducing unit cells, an acoustic focus can be integrated into the acoustic transducer chip by providing a variety of time delays between transducing unit cells consecutively coupled along the signal path in accordance with embodiments of the present invention. With an aligned array of at least two acoustic transducing unit cells, beam steering can be integrated into the acoustic transducer chip by providing appropriately selected time delays between the consecutively coupled transducing unit cells in accordance with embodiments of the invention.

Figure 3:
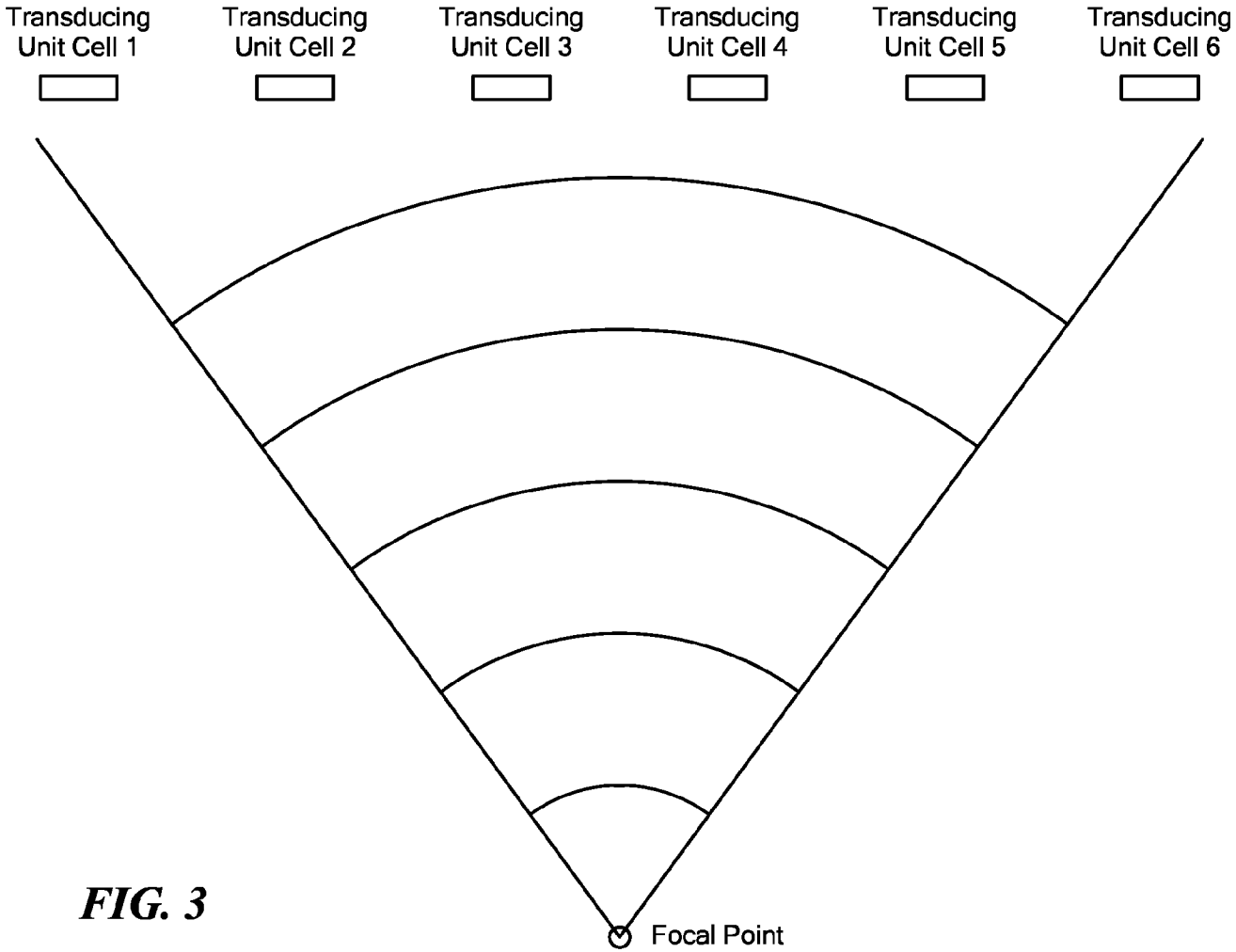
FIG. 3 is a representation of a focused phase front emanating from an array of acoustic transducing unit cells.

As shown in FIG. 2, time delays between adjacent acoustic transducing unit cells may be varied by including resistances in the top electrode path. In another embodiment of the invention, the resistances could be included in the bottom electrode path. In yet another embodiment, resistances could be included on both the top electrode and the bottom electrode paths. In accordance with embodiments of the invention, one signal pad 18 is provided at one end of the connections between transducing unit cells along the array and a second signal pad 18 is provided at an opposite end of the connections along the array. Accordingly, the same signal may be simultaneously applied to each of the two signal pads 18. Thus, a symmetrically shaped beam may be produced or symmetrically focused signals may be received. In the simple example of producing a symmetrically shaped beam, FIG. 3 shows a spherical phase front that can be produced with the structures taught by FIG. 2. An array of six transducing unit cells is exemplified in FIG. 3. For wave propagation close to the acoustic axis (also known as the paraxial approximation), the time delays between acoustic transducing unit cells would position the acoustic transducing unit cells in time so that each receives the signal input at points in time approximating points along a parabola created by a quadratic equation, as a quadratic equation is the crudest Taylor expansion of a circular or a spherical phase front. By making an acoustic transducer chip with a different variety of time delays between the acoustic transducing unit cells, there is no limit to the shape of an acoustic focus that can be integrated into the chip.

In making an acoustic transducer chip according to the embodiments of the invention, it can be advantageous to use doping of a semiconductor to produce the top electrode path and/or bottom electrode path between the acoustic transducing unit cells. The variety of electrical resistances can be determined by the type and amount of dopant used in the manufacturing process in the path between any two given acoustic transducing unit cells. In particular embodiments, doped amorphous silicon or doped polysilicon are the materials used for the resistive paths.

Figure 4A:
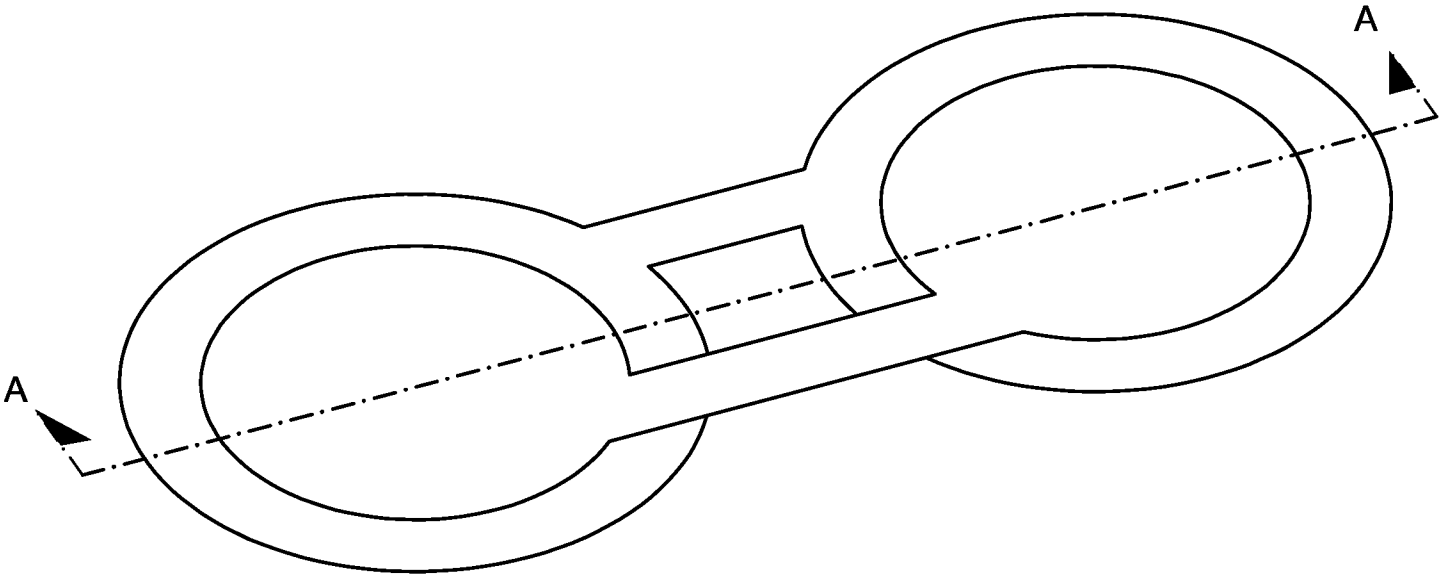
FIG. 4A is a top view of two adjacent capacitive micromachined ultrasonic transducing unit cells for use in an acoustic transducer chip of an embodiment of the present invention.
Figure 4B:
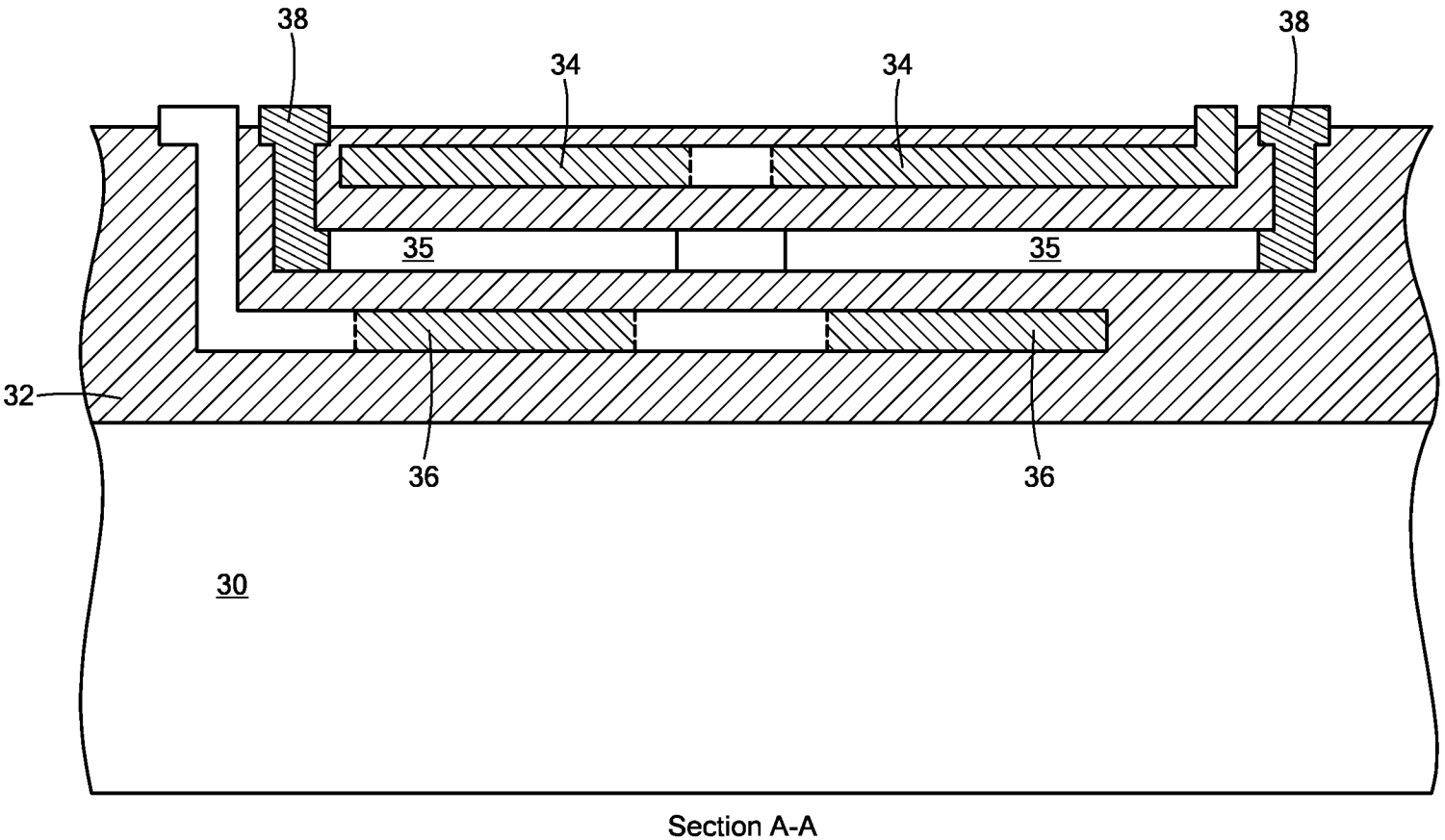
FIG. 4B is a side cross-sectional view of the two transducing unit cells of FIG. 4A taken along line 4B-4B.

Referring now to FIGS. 4A and 4B, an example of a pair of adjacent acoustic transducing unit cells is shown. The transducing unit cells are integrated upon a base layer 30. The chip may be fabricated from existing layers of a multilayered wafer. In particular embodiments, conductive layers may be used as sacrificial layers in the fabrication process. One suitable method for manufacturing MEMS devices, such as the acoustic transducer chips described herein, is described in U.S. Pat. No. 7,491,566 (Brosnihan et al.), the full disclosure of which is hereby incorporated by reference herein.

In FIG. 4B, the transducing unit cells and circuitry of the acoustic transducer chip are integrated upon the base layer 30. Base layer 30 is generally a semiconductor such as silicon, germanium or gallium arsenide, but it could be an organic material to act as acoustic backing material for instance. Typical acoustic backing material is selected to absorb acoustic waves and avoid parasitic effects. Polyurethane or other polymers may be used as the acoustic backing material. An insulator layer 32 sits atop the base layer 30. In one embodiment, the insulator layer is silicon dioxide. Other embodiments can use silicon nitride or other semiconductor dielectrics for the insulating layer. A lower conductive layer 36 resides within the insulator layer 32. A deposited layer 34 forms a deformable diaphragm in the transducing unit cell. In illustrative embodiments, the deposited layer 34 is a flexible and conductive material. Among other things, it may be a metal or a doped silicon-based material, such as silicon-germanium, polysilicon or amorphous silicon. The deposited layer 34 forms the top electrode 20 of the acoustic transducing unit cell. The lower conductive layer 36 serves as the bottom electrode 22. The lower conductive layer 36 forms a substantially stationary plate, while the deposited layer 34 forms the deformable plate of the acoustic transducing unit cell. During use oscillation of the deformable plate creates the acoustic signal in transmission or, in reception, produces an electrical signal responsive to an acoustic signal.

The acoustic transducing unit cell includes a cavity or chamber into which the deformable electrode can flex. In specific embodiments, the cavity 35 may be formed by removing a sacrificial conductive layer. Illustrative embodiments remove the sacrificial layer by means of a dry gas phase etch. For example, xenon difluoride may be applied to a sacrificial layer made of silicon. The insulator material around the sacrificial layer prevents the xenon difluoride from affecting other conductive layers. The insulator material therefore acts as a barrier for the other conductive layers. Such a barrier should not be necessary if any of the other conductive layers is not sensitive to the xenon difluoride (e.g. if the sacrificial layer is formed by a different material from that forming the other conductive layers). If the sacrificial layers are formed by a metal, however, illustrative embodiments may use a wet metal etch.

After removing the sacrificial layers to form the cavity 35, the cavity is sealed by depositing plugs 38 over the etch holes. In the case of making a capacitive micromachined ultrasonic transducer (CMUT), the cavity 35 is evacuated. The plug would thus be deposited while the chip is in an environment having a pressure that is lower than atmospheric pressure. Indeed, a vacuum may be used. Preferably, the seal formed by plugs 38 is hermetic. In particular embodiments, the seal 38 may be formed by deposition of a nitride or an oxynitride layer to fill the etch holes.

Figure 5:
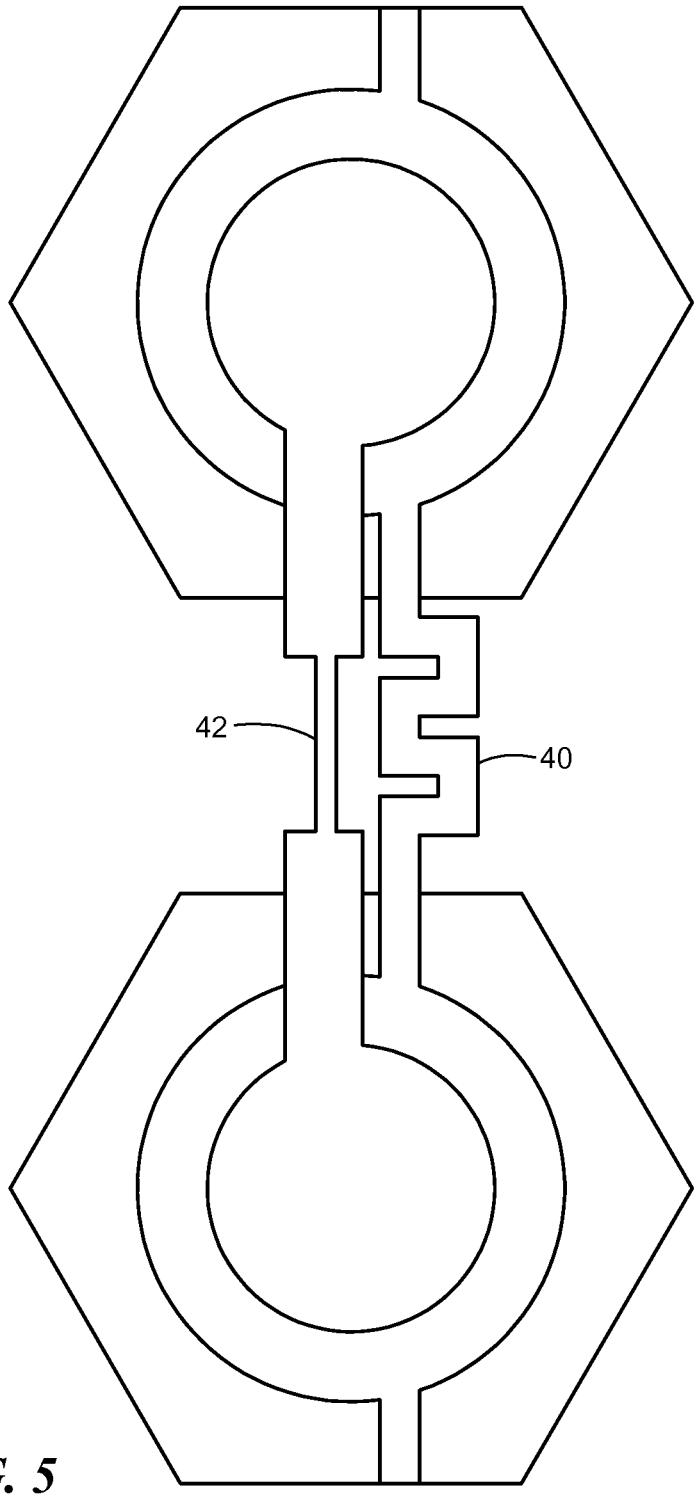
FIG. 5 is a top view of two adjacent acoustic transducing unit cells in an embodiment of an acoustic transducer chip of an embodiment of the present invention.

The electrical signal path between top electrodes can be achieved with the exemplary embodiment of FIG. 5 by making the conductive deposited layer 34 in electrical contact with a conductive interconnect, such as layer 42. By forming conductive layer 42 from a doped semiconductor, the resistance of the path may be determined by the type or amount of doping. Also the shape of the area doped may influence the resistance between two acoustic transducing unit cells. Similar conductive interconnects 40 may be fabricated into the acoustic transducer chip so as to be in contact with the lower conductive layer 36 so as to create a path between bottom electrodes. The doped path between two adjacent acoustic transducing unit cells may assume any of a variety of shapes and sizes. For example, FIG. 5 shows two alternative designs for a conductive path. The interconnect 40 is shown as a serpentine path. The interconnect 42 is shown as a resistive bottleneck in the path. A resistive bottleneck would typically be used to increase the resistance between unit cells. A wider path would have the reverse effect: decrease the resistance between unit cells connected by that path. A doping profile in terms of type, amount, shape and size may be used in making an acoustic transducer chip so as to set the series of resistances between adjacent acoustic transducing unit cells to produce the desired focus or shaped beam.

In other embodiments, the variety of resistances between adjacent acoustic transducing unit cells can be programmable after chip fabrication. One method of modifying resistances is through resistance trimming of trimmable resistors provided so as to be electrically coupled between the transducing unit cells. In another embodiment, a library of possible resistances may be fabricated into the chip permitting selection of the resistances post-fabrication. Resistances would be selected by cutting links with a laser or other such semiconductor processing equipment. In a still further embodiment, the resistances can be provided by transistors whose effective resistance can be controlled with a signal that adjusts the gate voltage. As such, the chip would be readily programmable after fabrication.

Figure 6A:
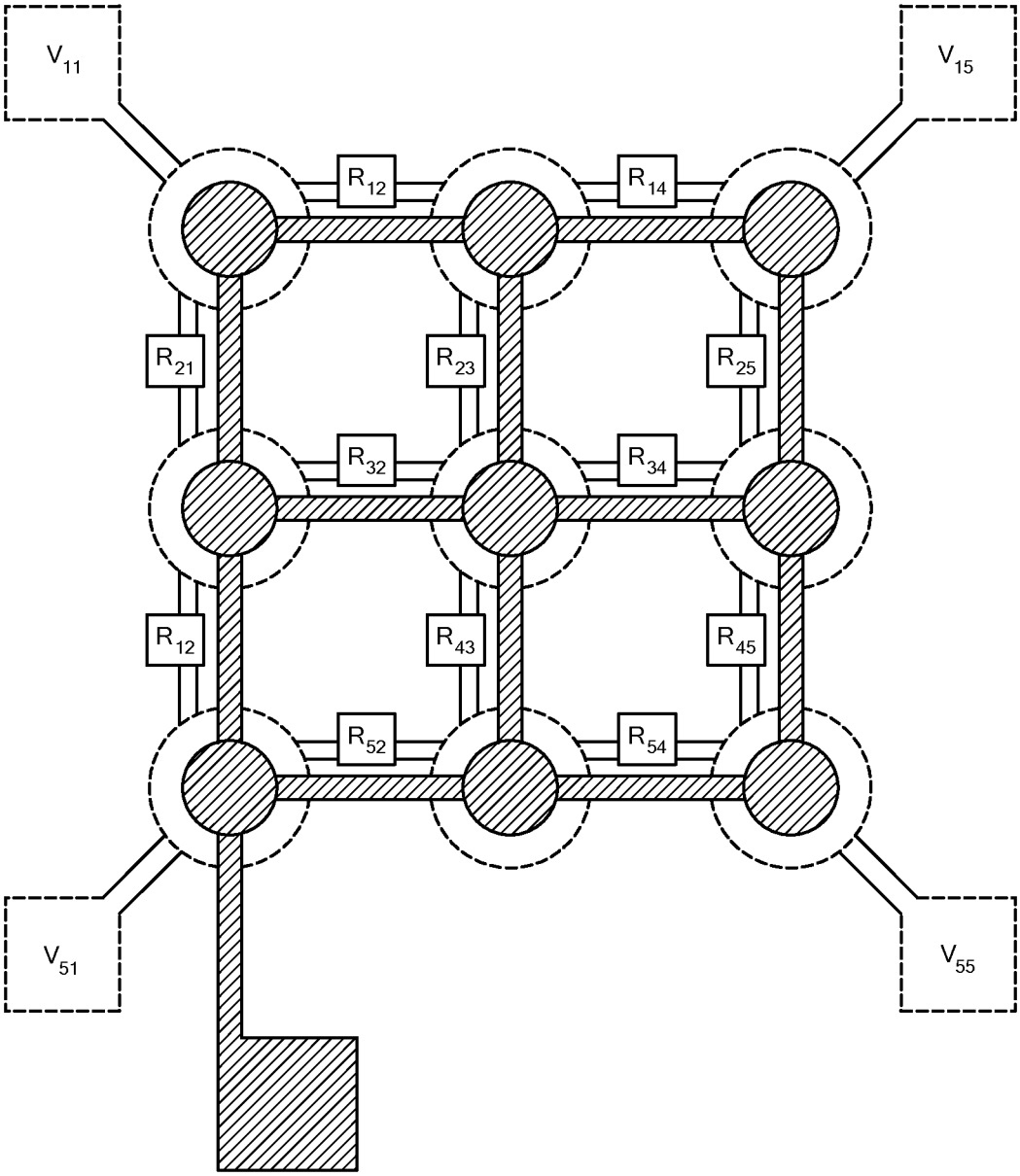
FIG. 6A is a top schematic view of an alternative two dimensional array of acoustic transducing unit cells of an embodiment of the present invention.
Figure 6B:
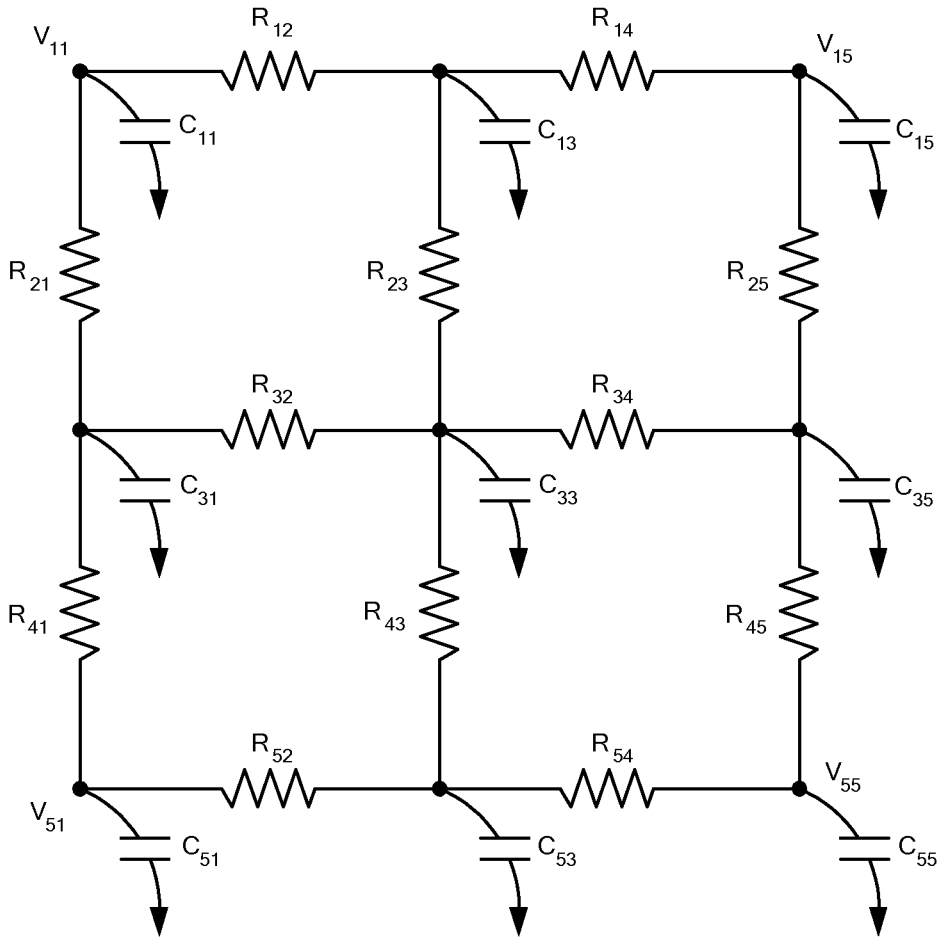
FIG. 6B is an electrical schematic of the two dimensional array of FIG. 6A.

As shown in FIG. 6, more complex acoustic transducer chips can be formed with two dimensional arrays. For example, connections can be made between transducing unit cells in the azimuthal direction in addition to the connections in the elevational direction. The resistances between adjacent transducers in the azimuthal direction can also be adjusted to provide focusing and beam shaping in this additional direction. It is shown in FIG. 6 that signal pads may be located at all four corners of a rectangular array of transducing unit cells. One could apply the signal to any two of the signal pads or all four of the signal pads. Indeed, the signal can be applied at one signal pad and to the signal pad located at an end of the connected cells diagonally opposite to that signal pad.

Figure 7:
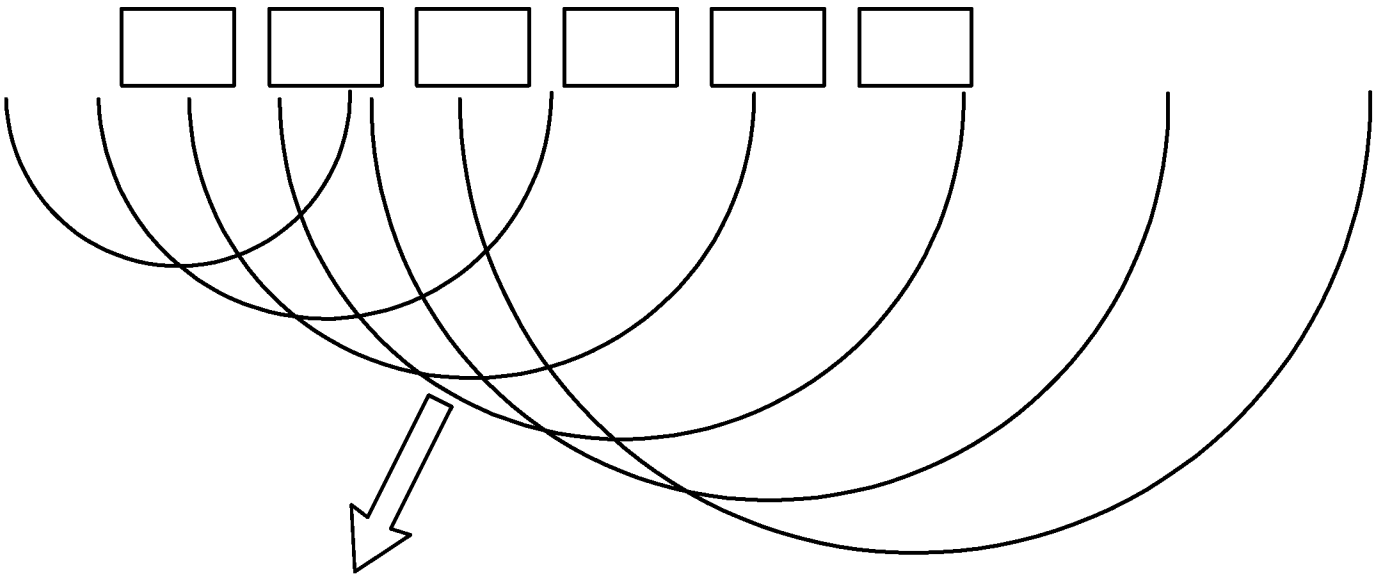
FIG. 7 is a representation of beam steering from an array of acoustic transducing unit cells in an acoustic transducer chip.

In addition or instead of beam shaping and focusing, acoustic transducer chips may be fabricated with integrated beam steering. Beam steering could be simply implemented with an array of as few as two acoustic transducing unit cells. Additional aligned acoustic transducing unit cells may achieve a beam steering as shown in FIG. 7. Typically, a signal is provided from one end of the array. Instead of simultaneously triggering the transducing unit cells, resistances between adjacent acoustic transducing unit cells either through the top electrodes and/or through the bottom electrodes may impose delays resulting in the production of beams that have been steered. The time delays for achieving beam steering may be accomplished through a variety of resistances or a variety of bias capacitances from one acoustic transducing unit cell to its adjacent acoustic transducing unit cell. It may be desirable to provide equal time delays between consecutively coupled transducing unit cells along an array to acoustically steer a beam. Whereas without steering a beam produced by an aligned array of transducing unit cells is emitted normal to the top surface of the acoustic chip on which the array of transducing unit cells is disposed, a steered beam is sent in a direction non-normal to the surface of the chip.

The embodiments of the invention described above are intended to be merely exemplary; numerous variations and modifications will be apparent to those skilled in the art. For example, instead of using CMUTs, acoustic transducer chips can be made with piezoelectric transducers or piezoelectric micromachined ultrasonic transducers (PMUTs). All such variations and modifications are intended to be within the scope of the present invention as defined in any appended claims.

What is claimed is:

1. An acoustic transducer chip comprising:

a semiconductor chip;

an array of at least three acoustic transducing unit cells integrated upon a base layer of the semiconductor chip; and a resistive signal path including interconnects between acoustic transducing unit cells in the array, the resistive signal path being fabricated into the semiconductor chip and electrically coupling the at least three acoustic transducing unit cells, wherein the resistive signal path imposes a variety of time delays between consecutively coupled acoustic tranducing unit cells along the array so as to acoustically focus the array.

2. The acoustic transducer chip of claim 1, wherein each acoustic transducing unit cell includes a pair of electrodes.

3. The acoustic transducer chip of claim 2, wherein at least one electrode of each pair is deformable.

4. The acoustic transducer chip of claim 2, wherein one electrode of each pair is deformable and further comprising a vacuum cavity adjacent to the deformable electrode.

5. The acoustic transducer chip of claim 1, wherein the variety of time delays is formed by a variety of electrical resistances between acoustic transducing unit cells along the array.

6. The acoustic transducer chip of claim 5, wherein the variety of electrical resistances is established by a location dependent doping profile.

7. The acoustic transducer chip of claim 5, wherein the variety of electrical resistances is established by programmable resistors between the transducing unit cells.

8. The acoustic transducer chip of claim 5, wherein the variety of electrical resistances is established by a library of possible resistors available for use between the transducing unit cells.

9. The acoustic transducer chip of claim 1, wherein the transducing unit cells are capacitive micromachined ultrasonic transducers.

10. The acoustic transducer chip of claim 1, wherein the transducing unit cells are either piezoelectric transducers or piezoelectric micromachined ultrasonic transducers (PMUTs).

11. The acoustic transducer chip of claim 1, further comprising one or more additional arrays of at least three acoustic transducing unit cells so as to form a two dimensional array of acoustic transducing unit cells.

12. The acoustic transducer chip of claim 1, wherein the acoustic transducing unit cells of the array are substantially aligned along an axis of alignment.

13. The acoustic transducer chip of claim 12, wherein the acoustic transducing unit cells of the array operate within a range of acoustic frequencies and wherein all of the acoustic transducing unit cells in the array are located within one-half wavelength at the highest frequency in the range of the axis of alignment.

14. The acoustic transducer chip of claim 1, wherein the array of at least three acoustic transducing unit cells is acoustically focused to generate a spherical phase front.

15. The acoustic transducer chip of claim 2, wherein the variety of time delays is formed by differences in the capacitances of the electrode pairs of the transducing unit cells in the array.

16. The acoustic transducer chip of claim 2, wherein the variety of time delays is formed by differences in the capacitances of the electrode pairs of the transducing unit cells in the array and a variety of electrical resistances between transducing unit cells along the array.

17. The acoustic transducer chip of claim 1, further comprising a first signal pad connected to the signal path at one end of the array of at least three acoustic transducing unit cells and a second signal pad connected to the signal path at an opposite end of the array from the first signal pad.

18. The acoustic transducer chip of claim 17, wherein the variety of time delays is configured to acoustically focus the array with the same signal being applied to opposite ends of the array.

19. An acoustic transducer chip comprising:

a semiconductor chip;

an array of a plurality of acoustic transducing unit cells disposed along a top surface of the semiconductor chip and integrated upon a base layer of the chip; and a resistive signal path including interconnects between acoustic transducing unit cells in the array, the resistive signal path being fabricated into the semiconductor chip and electrically coupling adjacent acoustic transducing unit cells along the array, wherein the resistive signal path imposes time delays between consecutively coupled acoustic transducing unit cells along the array so as to acoustically steer an acoustic beam in a direction non-normal to the top surface in which the array is disposed.

20. The acoustic transducer chip of claim 19, wherein each acoustic transducing unit cell includes a pair of electrodes.

21. The acoustic transducer chip of claim 20, wherein at least one electrode of each pair is deformable.

22. The acoustic transducer chip of claim 20, wherein one electrode of each pair is deformable and further comprising a vacuum cavity adjacent to the deformable electrode.

23. The acoustic transducer chip of claim 19, wherein the transducing unit cells are capacitive micromachined ultrasonic transducers.

24. The acoustic transducer chip of claim 19 wherein the transducing unit cells are either piezoelectric transducers or piezoelectric micromachined ultrasonic transducers (PMUTs).

25. The acoustic transducer chip of claim 19, further comprising one or more additional arrays of a plurality of acoustic transducing unit cells so as to form a two dimensional array of acoustic transducing unit cells.

26. The acoustic transducer chip of claim 20, further comprising differences in the capacitances of the electrode pairs of the transducing unit cells in the array that contribute to beam steering.

27. The acoustic transducer chip of claim 19, wherein the resistive signal path is formed by a variety of electrical resistances between transducing unit cells along the array.

28. An acoustic transducer chip comprising:

a plurality of acoustic elements, each acoustic element including:

at least one array of capacitive micromachined ultrasonic transducing unit cells (CMUTs), each transducing unit cell including a top plate and a bottom plate, wherein the top plates of the at least one array are electrically connected by a top electrode path and the bottom plates of the at least one array are electrically connected by a bottom electrode path;

a first signal pad electrically connected to one of the top electrode path and the bottom electrode path at one end of the connections through the at least one array of CMUTs;

a second signal pad electrically connected to the one of the top electrode path and the bottom electrode path at an opposite end of the connections through the at least one array of CMUTs from the first signal pad; and at least one ground pad electrically connected to the other of the top electrode path and the bottom electrode path.

29. The acoustic transducer chip of claim 28 wherein the one of the top electrode path and the bottom electrode path has a variety of time delays between adjacent CMUTs along the one path so as to acoustically focus the at least one array of CMUTs.

30. The acoustic transducer chip of claim 29, wherein the variety of time delays is formed by a variety of electrical resistances between acoustic transducing unit cells along the array.

31. An acoustic transducer chip comprising:

a semiconductor chip;

an array of at least three acoustic transducing unit cells integrated upon a base layer of the semiconductor chip; and a signal path including interconnects between acoustic transducing unit cells in the array, the signal path being fabricated into the semiconductor chip and electrically coupling the at least three acoustic transducing unit cells, wherein the signal path imposes a variety of time delays formed by a variety of electrical resistances between consecutively coupled acoustic transducing unit cells along the array so as to acoustically focus the array and wherein the variety of electrical resistances is established by a library of possible resistors available for use between the transducing unit cells.

32. An acoustic transducer chip comprising:

a semiconductor chip;

an array of at least three acoustic transducing unit cells integrated upon a base layer of the semiconductor chip;

a signal path including interconnects between acoustic transducing unit cells in the array, the signal path being fabricated into the semiconductor chip and electrically coupling the at least three acoustic transducing unit cells, wherein the signal path imposes a variety of time delays between consecutively coupled acoustic transducing unit cells along the array; and a first signal pad connected to the signal path at one end of the array of at least three acoustic transducing unit cells and a second signal pad connected to the signal path at an opposite end of the array from the first signal pad wherein the variety of time delays is configured so as to acoustically focus the array with the same signal being applied to each of the first signal pad and the second signal pad.

* * * * *

UNITED STATES PATENT AND TRADEMARK OFFICE

CERTIFICATE OF CORRECTION

PATENT NO. : 8,498,178 B2
APPLICATION NO. : 13/324565
DATED : July 30, 2013
INVENTOR(S) : Antoine et al.

It is certified that error appears in the above-identified patent and that said Letters Patent is hereby corrected as shown below:

In the Claims

In Col. 8, line 29
replace "claim 17"
with --claim 1--

In Col. 8, line 31
replace "with the same signal being applied"
with --when a same signal is applied--

Signed and Sealed this
Fifteenth Day of October, 2013

Teresa Stanek Rea

Teresa Stanek Rea
*Deputy Director of the United States Patent and Trademark Office*